US007938592B2

(12) United States Patent
Tamano

(10) Patent No.: US 7,938,592 B2
(45) Date of Patent: May 10, 2011

(54) WRITING IMPLEMENT

(75) Inventor: Hisami Tamano, Kanagawa (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 133 days.

(21) Appl. No.: 12/440,270

(22) PCT Filed: Aug. 27, 2007

(86) PCT No.: PCT/JP2007/067085
§ 371 (c)(1),
(2), (4) Date: Mar. 6, 2009

(87) PCT Pub. No.: WO2008/029747
PCT Pub. Date: Mar. 13, 2008

(65) Prior Publication Data

US 2010/0172689 A1 Jul. 8, 2010

(30) Foreign Application Priority Data

Sep. 8, 2006 (JP) ..... 2006-244552

(51) Int. Cl.
*B43K 5/02* (2006.01)

(52) U.S. Cl. ..... 401/224; 401/223; 401/227; 401/241; 401/242

(58) Field of Classification Search ..... 401/196, 401/198, 205, 209, 214, 217, 223, 224, 225, 401/227, 230, 241, 242, 232
See application file for complete search history.

(56) References Cited

U.S. PATENT DOCUMENTS 3,129,696 A 4/1964 Sklar
4,770,558 A 9/1988 Frietsch
5,087,144 A * 2/1992 Wada et al. ..... 401/227
(Continued)

FOREIGN PATENT DOCUMENTS

FR 1 023 240 A 3/1953
(Continued)

OTHER PUBLICATIONS

Office Action dated Mar. 23, 2010, in counterpart Chinese Application No. 200780033045.7, 4 pages.
(Continued)

*Primary Examiner* — Tuan N Nguyen
(74) *Attorney, Agent, or Firm* — Foley & Lardner LLP

(57) ABSTRACT

A refill of a low viscosity water-based ink ballpoint pen is provided with a housing, a pen tip attached to a front end of the housing, an ink tank (4) formed inside the housing, an ink guide member guiding ink in the ink tank (4) to the pen tip, and an air passage formed between the ink tank and the pen tip in the housing and connecting the ink tank and outside of the housing. The inside of the ink tank is divided by partition walls (11) into a plurality of ink chambers arranged in the longitudinal direction, and the ink guide member is used to guide the ink in these ink chambers from the ink chambers close to the pen tip successively to the pen tip. A substantially uniform clearance (13) is provided over the entire circumferences between the outer circumferential surface of each partition wall (11) and the inner circumferential surface of the ink tank (4). A ring-shaped ink film formed at each clearance (13) is used to hold the ink in each ink chamber. Air flows into the ink chamber through the clearance (13).

12 Claims, 10 Drawing Sheets

U.S. PATENT DOCUMENTS

| | | | | |
|---|---|---|---|---|
| 5,957,609 | A * | 9/1999 | Morita et al. | 401/214 |
| 6,607,325 | B2 * | 8/2003 | Hori | 401/205 |
| 2003/0068191 | A1 | 4/2003 | Hori | |
| 2005/0249542 | A1 | 11/2005 | Hori | |

FOREIGN PATENT DOCUMENTS

| | | | |
|---|---|---|---|
| JP | 62-220400 | A | 9/1987 |
| JP | 2001-001682 | A | 1/2001 |
| JP | 2001-315483 | A | 11/2001 |
| JP | 3436728 | B2 | 6/2003 |
| JP | 2004-050694 | A | 2/2004 |
| WO | WO 2004/00575 | A1 | 12/2003 |

OTHER PUBLICATIONS

Explanation Brief filed Feb. 7, 2008 in counterpart Japanese Application No. 2006-244552, 1 page, with English translation, 2 pages.

Supplementary European Search Report dated Jul. 21, 2010, in corresponding EP 07806558.8, 9 pages.

* cited by examiner

WRITING IMPLEMENT

TECHNICAL FIELD

The present invention relates to a writing implement.

BACKGROUND ART

Known in the art is a writing implement provided with a housing, a pen tip attached to a front end of the housing, an ink tank formed inside the housing, an ink guide member guiding ink in the ink tank to the pen tip, and an air passage formed between the ink tank and the pen tip in the housing and having one end connected to an end of the ink tank at the pen tip side and another end connected to the outside of the housing.

In this writing implement, air flows into the ink tank for the amount of consumed ink. However, if the air in this ink tank expands due to a change in the ambient air pressure or temperature etc., the ink in the ink tank is liable to be pushed out by the air from the ink tank and to flow out through the pen tip or air passage to the outside of the writing implement.

Thus, there is known a writing implement dividing the inside of the ink tank by partition walls into a plurality of ink chambers arranged in the longitudinal direction, arranging an ink guide member so as to extend inside a through hole formed at the center of the partition walls, using the ink guide member to guide the ink in these ink chambers from the ink chambers at the pen tip side successively to the pen tip, using an ink film formed in a ring-shaped clearance between the outer circumferential surface of ink guide member and the inner circumferential surface of the through hole to hold the ink in the ink chambers, and making air flow into the ink chambers through this clearance (see Japanese Patent No. 3436728, FIG. 1 etc.). By doing this, roughly speaking, the air flowing into the ink tank is separated from the ink and is communicated through the air passage to the outside of the housing. Therefore, even if the air in the ink tank expands, the ink in the ink tank is kept from being pushed out by the air to the outside of the ink tank.

In the writing implement described in Japanese Patent No. 3436728, the ink guide member is comprised of a bundle of fibers formed by bundling together a large number of fibers and is held at its two ends at the housing. In this case, the ink guide member itself is low in strength, so in practice it is extremely difficult to form a uniform clearance between the outer circumferential surface of the ink guide member and the inner circumferential surface of the through hole. Therefore, in practice, the clearance between the outer circumferential surface of the ink guide member and the inner circumferential surface of the through hole becomes uneven in the circumferential direction. That is, there are portions where the clearance is large and portions where it is small. However, while explained in detail later, at the portions where the clearance is large, the ink holding force of the ink film becomes smaller and therefore the ink is liable not to be able to be reliably held in the ink chambers.

In this case, if providing a cutaway part in the outer circumferential surface of the partition wall and using the ink film formed at this cutaway part to hold the ink in the ink chamber and making air flow through this cutaway part to the inside of the ink chamber, it is considered that this problem can be solved (see Japanese Patent No. 3436728, FIG. 19 to FIG. 21 and Japanese Patent Publication (A) No. 62-220400, FIG. 1).

In this regard, when providing a cutaway part in the outer circumferential surface of the partition wall, in the state with the writing implement tilted with respect to the vertical line, the position of the cutaway part, that is, the ink film, with respect to the longitudinal axis of the writing implement will change at each instance. That is, there will be cases where the ink film is positioned above the longitudinal axis of the writing implement and cases where it is positioned below it.

However, the behavior of the air passing through the ink film and flowing into the ink chambers can change in accordance with the position of the ink film with respect to the longitudinal axis of the writing implement. That is, the behavior of the air flowing into the ink chambers is liable to differ between the case where the ink film is positioned above the longitudinal axis of the writing implement and the case where it is positioned below it. This means that the behavior of the air in the ink tank is unstable.

Note that in the writing implement of Japanese Patent Publication (A) No. 62-220400, a ring-shaped clearance (33) is formed between the outer circumferential surface of each partition wall and the inner circumferential surface of the ink tank, but since the cutaway part (36) is formed, no ring-shaped ink film is formed.

DISCLOSURE OF THE INVENTION

Thus an object of the present invention is to provide a writing implement able to stabilize the behavior of the air inside the ink tank.

According to the present invention, there is provided a writing implement provided with a housing, a pen tip attached to a front end of the housing, an ink tank formed inside the housing, an ink guide member guiding ink inside the ink tank to the pen tip, and an air passage formed between the ink tank and the pen tip in the housing and having one end connected to an end of the ink tank at the pen tip side and another end connected to the outside of the housing, wherein the inside of the ink tank is divided by a partition wall into a plurality of ink chambers arranged in the longitudinal direction, and the ink in these ink chambers is guided from the ink chambers close to the pen tip successively to the pen tip by the ink guide member, a substantially uniform clearance is provided around the entire circumference between the outer circumferential surface of each partition wall and the inner circumferential surface of the ink tank, and the ink is held inside the ink chambers by a ring-shaped ink film formed in the clearance, while air is made to flow into the ink chambers through the clearances.

BEST MODE FOR CARRYING OUT THE INVENTION

Figure 1:
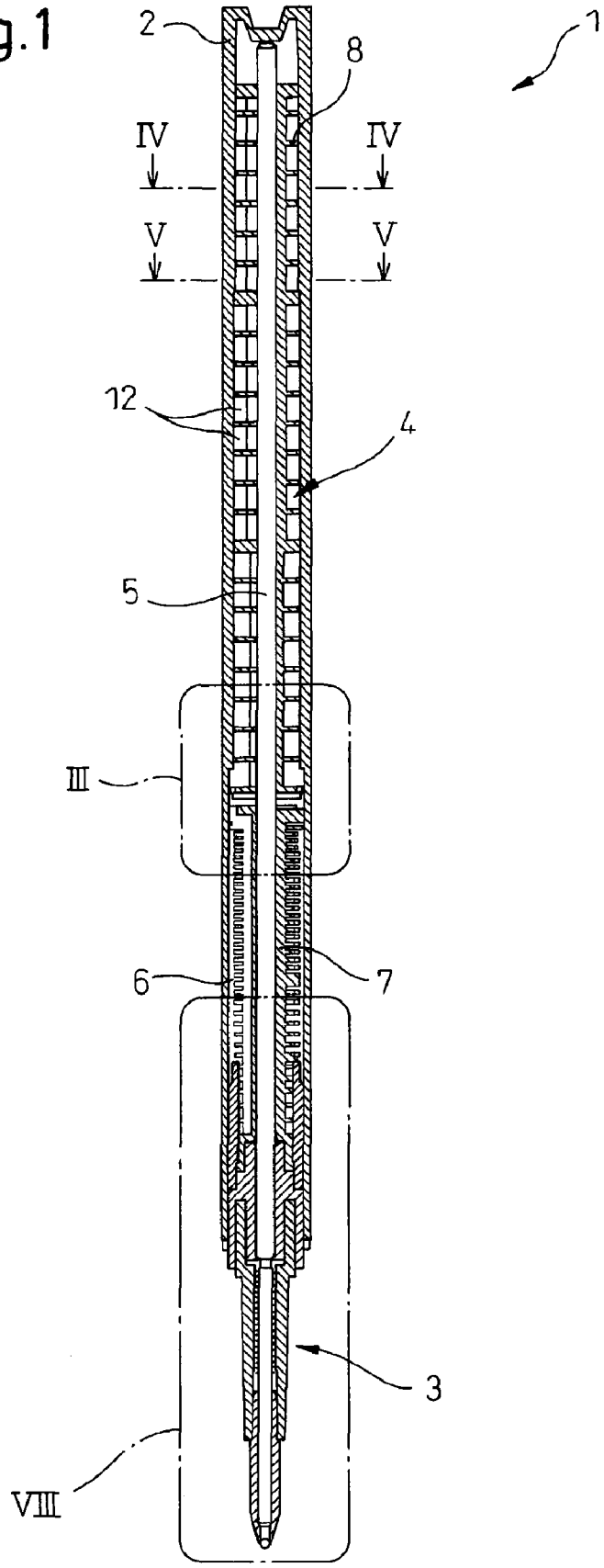
FIG. 1 is a vertical cross-sectional view of a refill.

FIG. 1 shows the case of application of the present invention to a refill of a ballpoint pen.

Referring to FIG. 1, 1 designates a refill used inserted in a ballpoint pen body (not shown), 2 designates a housing, 3 designates a pen tip attached to a front end of the housing 2, 4 designates an ink tank formed inside the housing 2 and filled with a liquid ink, 5 designates an ink guide member guiding ink in the ink tank 4 to the pen tip 3, 6 designates an air passage formed between the ink tank 4 and the pen tip 3 in the housing 2 and communicating the inside of the ink tank 4 and the outside of the housing 2, and 7 designates a collector arranged inside the air passage 6. The ink guide member 5 is for example comprised of a porous fiber body formed by bundling synthetic fibers and having pores continuing in the longitudinal direction. Here, in an embodiment according to the present invention, the ink is comprised of a water-based ink with a low viscosity, that is, a viscosity of for example 10 Pa·s or less.

First, the ink tank 4 will be explained.

Figure 2:
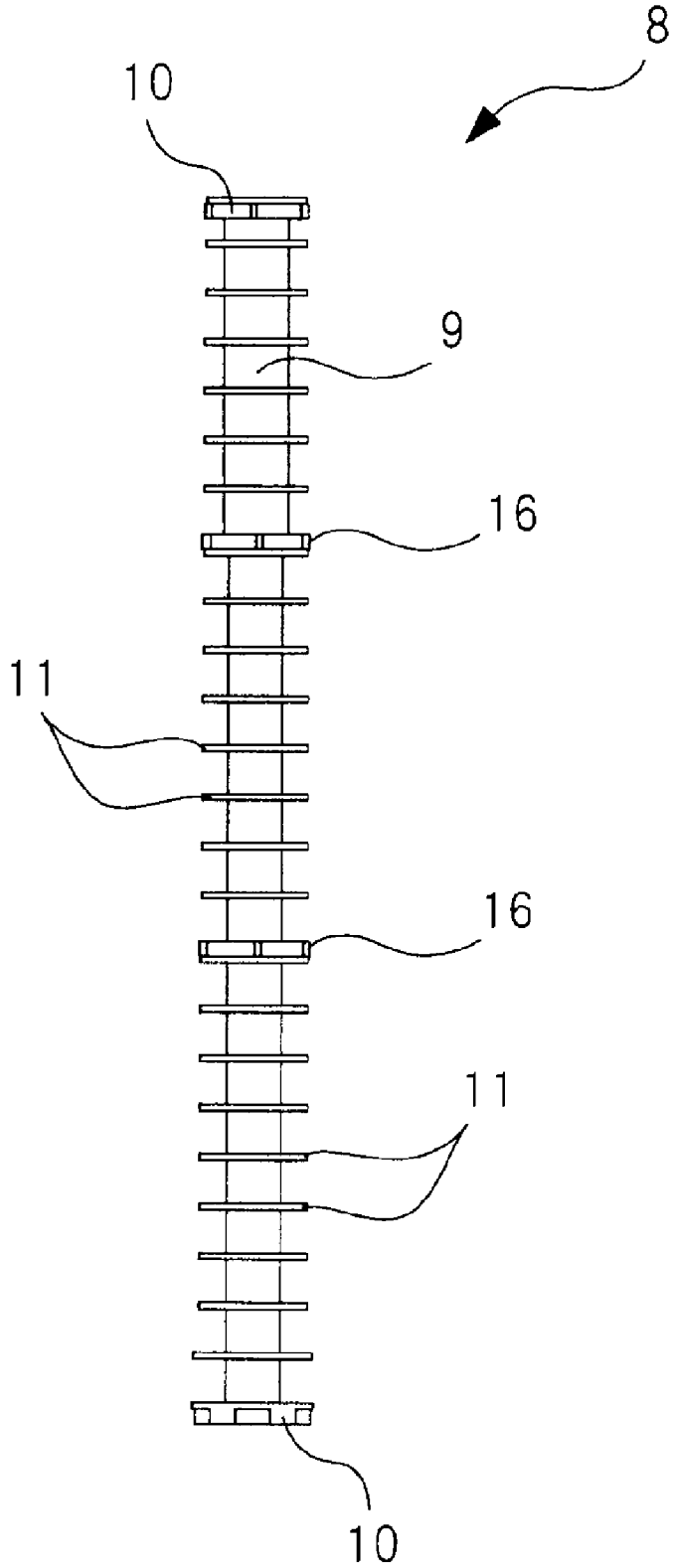
FIG. 2 is a plan view of an insertion member.
Figure 3:
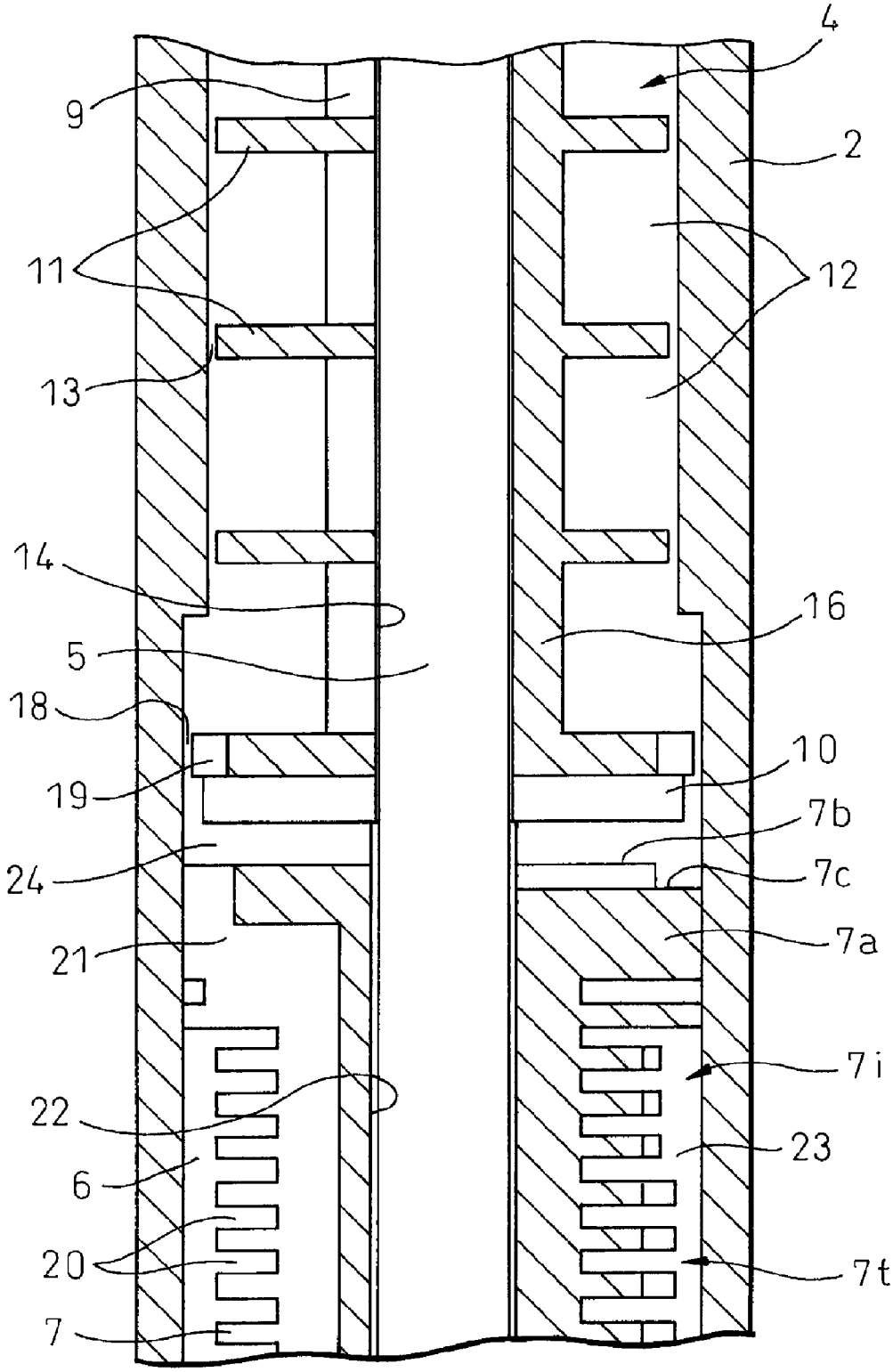
FIG. 3 is an enlarged view of a part III of FIG. 1.

Inside the ink tank 4, an insertion member 8 shown in FIG. 2 is inserted. The insertion member 8 is formed for example from a plastic and, as shown in FIG. 2, is provided with a cylindrical part 9, a pair of end walls 10, and at least one, for example, a plurality of, partition walls 11 arranged between these end walls 10 separated in the longitudinal direction. When this insertion member 8 is inserted into the ink tank 4, as shown in FIG. 1 and FIG. 3, each adjoining pair of partition walls 11 or a partition wall 11 and end wall 10, the outer circumferential surface of the cylindrical part 9, and the inner circumferential surface of the housing 2 define ring-shaped ink chambers 12 in the ink tank 4. That is, the inside of the ink tank 4 is divided by the partition walls 11 into a plurality of ink chambers 12 arranged in the longitudinal direction.

Figure 4:
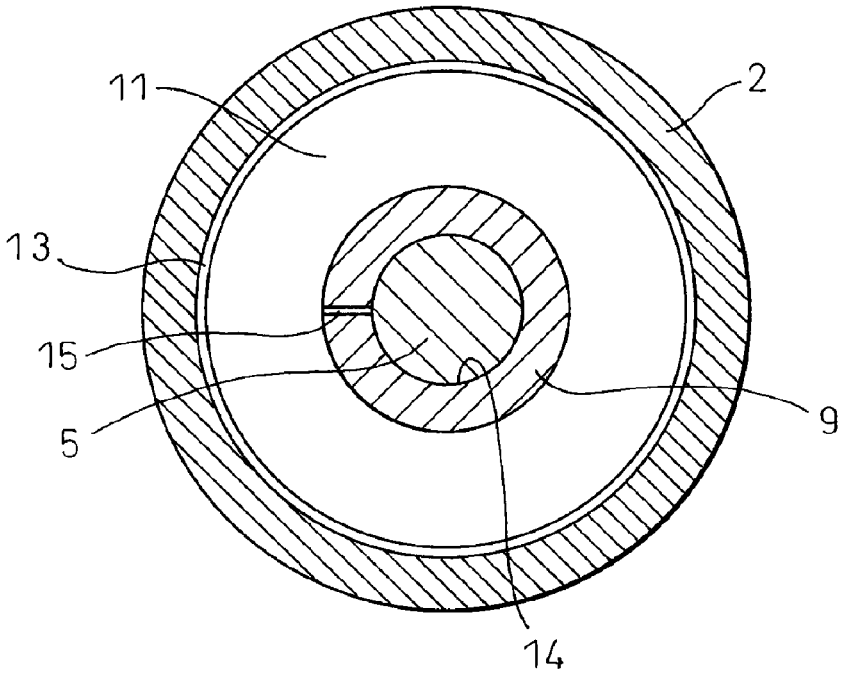
FIG. 4 is a horizontal cross-sectional view along the line IV-IV of FIG. 1.

As shown in FIG. 3 and FIG. 4, a ring-shaped clearance 13 is provided between the outer circumferential surface of each partition wall 11 and the inner circumferential surface of the housing 2 or the ink tank 4. In this case, the outer circumferential surface of the partition wall 11 and the inner circumferential surface of the ink tank 4 are not provided with any cutaway parts or projections, therefore, the clearance 13 becomes substantially even around the entire circumference of the partition wall 11.

Figure 5:
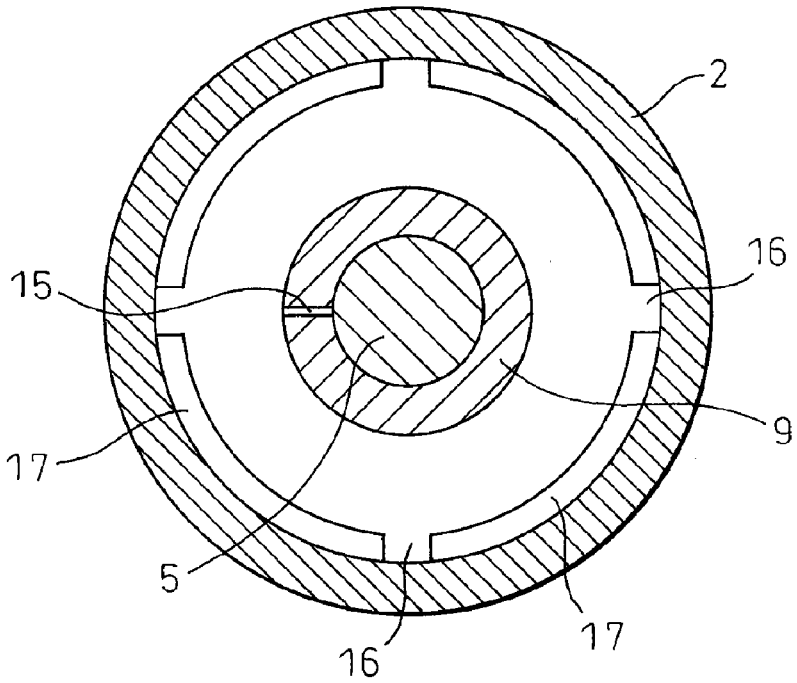
FIG. 5 is a horizontal cross-sectional view along the line V-V of FIG. 1, FIGS. 6A and 6B are enlarged cross-sectional views for explaining the action of the ink chambers.

Furthermore, referring to FIG. 3, FIG. 4, and FIG. 5, a guide member receiving hole 14 extends passing through a cylindrical part 9. This guide member receiving hole 14 receives the ink guide member 5 therein. Further, the cylindrical part 9 is formed with ink guide paths 15 communicating the ink chambers 12 and the inside of the guide member receiving hole 14. Ink in the ink chambers 12 reach the ink guide member 5 through these ink guide paths 15. Note that in the embodiment according to the present invention, the ink guide paths 15 are comprised of slits of a slight width, but may also be other shapes.

Further, as shown in FIG. 1, FIG. 2, and FIG. 5, support projections 16 projecting outward in the radial direction are formed at intermediate positions of the insertion member 8 in the longitudinal direction, that is, between the pair of end walls 10. These support projections 16 abut against the inner circumferential surface of the ink tank 4 to support the insertion member 8 when the insertion member 8 is inserted into the ink tank 4. By doing this, even if the insertion member 8 is warped, the clearance 13 can be maintained substantially constant. Furthermore, as shown in FIG. 5, communicating paths 17 are formed between the support projections 16. Ink can flow through these communicating paths 17. Note that in the embodiment according to the present invention, the support projections 16 are provided at two locations, but one location is enough.

As shown in FIG. 3 particularly, a clearance 18 is formed between the outer circumferential surface of the end wall 10 at the pen tip 3 side and the inner circumferential surface of the housing 2. Further, a cutaway part 19 is formed at the outer circumferential surface of this end wall 10. Therefore, the air passage 6 is connected to the inside of the ink tank 4 through these clearance 18 and cutaway part 19.

Figure 6B:
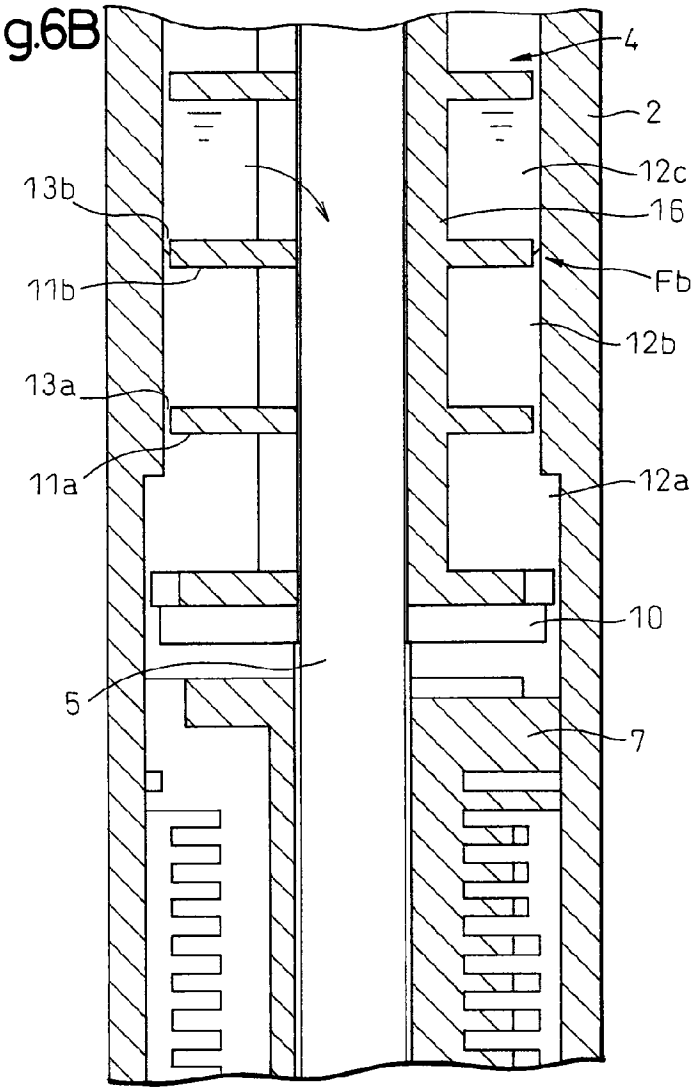
Figure 6A:
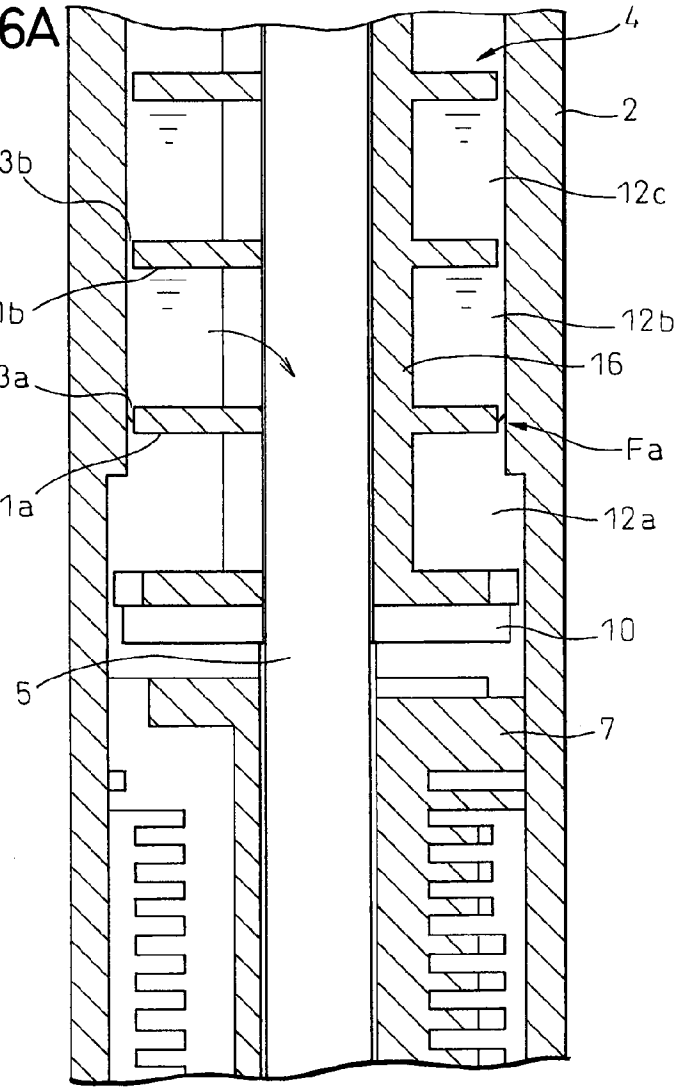

FIG. 6A shows ink chambers 12 at the time when the refill 1 is not yet used. In this embodiment according to the present invention, the ink chamber 12*a* adjoining the air passage 6 is not filled with ink. Therefore, the ink chamber 12*a* is filled with air. As opposed to this, the ink chambers 12*b*, 12*c*, etc. above or behind the ink chamber 12*a* are filled with ink.

In this case, at the clearance 13*a* formed around the partition wall 11*a* between the ink chamber 12*a* and the ink chamber 12*b*, capillary force causes the formation of a ring-shaped ink film or meniscus Fa, whereby the ink is held inside the ink chamber 12*b*.

When ink is consumed from the pen tip 3, the ink in the ink chamber 12*b* close to the pen tip 3 is guided to the ink guide member 5 and the amount of ink in the ink chamber 12*b* is gradually reduced. In this case, air passes through the ink film Fa and flows into the ink chamber 12*b* by the amount of ink flowing out from the ink chamber 12*b*. In this case, the ink film Fa is substantially even around the entire circumference of the partition wall 11*a*, so regardless of the position of the refill 1, a certain behavior of the air can be obtained.

When the ink in the ink chamber 12*b* is substantially entirely consumed, as shown in FIG. 6B, the ring-shaped ink film Fb formed at the clearance 13*b* around the partition wall 11*b* holds the ink in the ink chamber 12*c*. Air passes through the ink film Fb and flows into the ink chamber 12*c*. At this time, the inside of the ink chamber 12*b* is filled with air.

In this way, as the ink is consumed, ink is guided to the ink guide member 5 and consumed successively from the ink chambers 12 close to the pen tip 3. As a result, the ink chambers 12 close to the pen tip 3 are successively filled with air and the ink film successively moves to the rear end.

As explained at the start, when the ambient air pressure or temperature etc. changes, the air inside the ink chambers 12 expands or contracts. When the air expands, the air flows out through the clearances 13 around the partition walls 11 and clearance 18 and cutaway part 19 around the end wall 10 to the inside of the air passage 6. At this time, ink is almost never pushed out into the air passage 6. Further, even when the air contracts, air flows through the clearances 13 etc. from the air passage 6 to the ink chambers 12 and has no effect on the ink in the ink chambers 12.

Note that if the ink holding force at a clearance 13, that is, the strength of the ink film, is too strong, it will become difficult for air to flow into the ink chamber 12 and it will become difficult for ink to be discharged from the pen tip 3. On the other hand, if the strength of the ink film is too weak, it will become difficult for the ink head to hold the ink in the ink chambers 12. Therefore, the strength of the ink film must be suitably adjusted. In this case, for example by adjusting the size of the clearance 13 or the thickness of the partition wall 11, the strength of the ink film can be adjusted. The optimum values of the size of the clearance 13 and the thickness of the partition wall 11 depend on the viscosity of the ink and the wettability with respect to the partition wall 11 and housing 2 and cannot be said to be of any extent overall. However, the clearance 13 for example can be set to tens to hundreds of micrometers, while the thickness of the partition wall 11 for example can be set to hundreds to thousands of micrometers. Note that the interval between the partition walls 11 is set so that almost no capillary force acts between these partition walls 11.

Next, the collector 7 and the air passage 6 will be explained.

The collector 7 is for holding the ink flowing out from the ink guide core 5 into the air passage 6 and returning the held ink to the ink guide member 5 to thereby prevent the ink from flowing out through the air passage 6 to the outside of the housing 2. Again referring to FIG. 3, the collector 7 has a plurality of ring-shaped grooves 20 arranged in the longitudinal direction, a slit 21 cutting across the ring-shaped grooves 20 and extending in the longitudinal direction, and a through hole 22 running through the collector 7. Inside this through hole 22, the ink guide member 5 extends. Further, when the collector 7 is attached inside the housing 2, a ring-shaped clearance 23 is formed between the outer circumferential surface of the collector 7 and the inner circumferential surface of the housing 2. As shown in FIG. 3, the clearance 23 is set large at the part of the collector 7 at the ink tank side, while the clearance 23 is set small at the other part 7*t* at the pen tip side. Note that in the embodiment according to the present invention, the collector 7 is arranged separated from the end wall 10 of the insertion member 8 or ink tank 4 in the longitudinal direction. The air passage 6 between the insertion member 8 and the collector 7 will be referred to as the ink outflow chamber 24, hereinafter.

Figure 7:
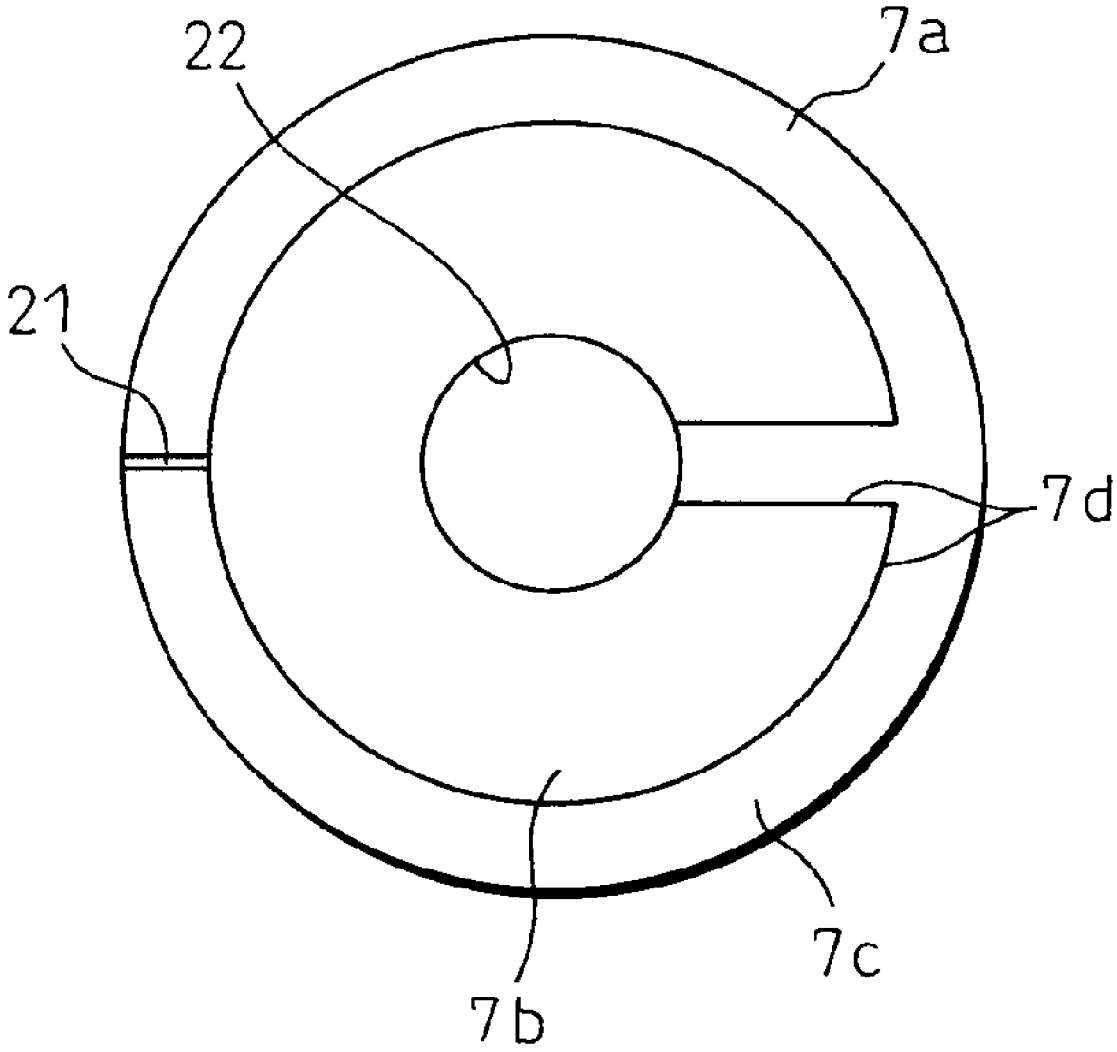
FIG. 7 is a plan view of a rear end of a collector.

Further, as shown in FIG. 7, at the rear end 7*a* of the collector 7 facing the ink outflow chamber 24, a projection 7*b* and a recess 7*c* formed at the opposite side from the slit 21 are formed. When forming the projection 7*b* and recess 7*c* in this way, corners 7*d* are formed. A capillary force occurs at such corners 7*d*, so ink reaching the rear end 7*a* of the collector 7 flows along the corners 7*d*.

Figure 8:
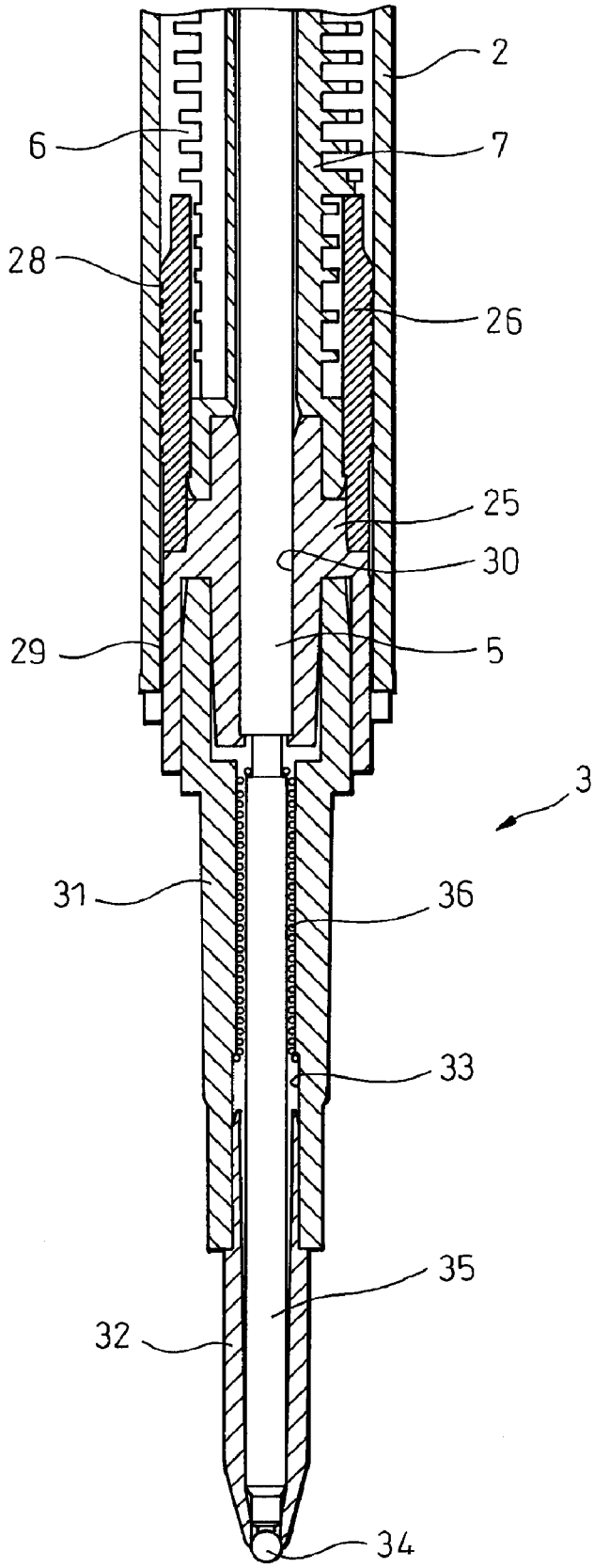
FIG. 8 is an enlarged view of a part VIII of FIG. 1.
Figure 9:
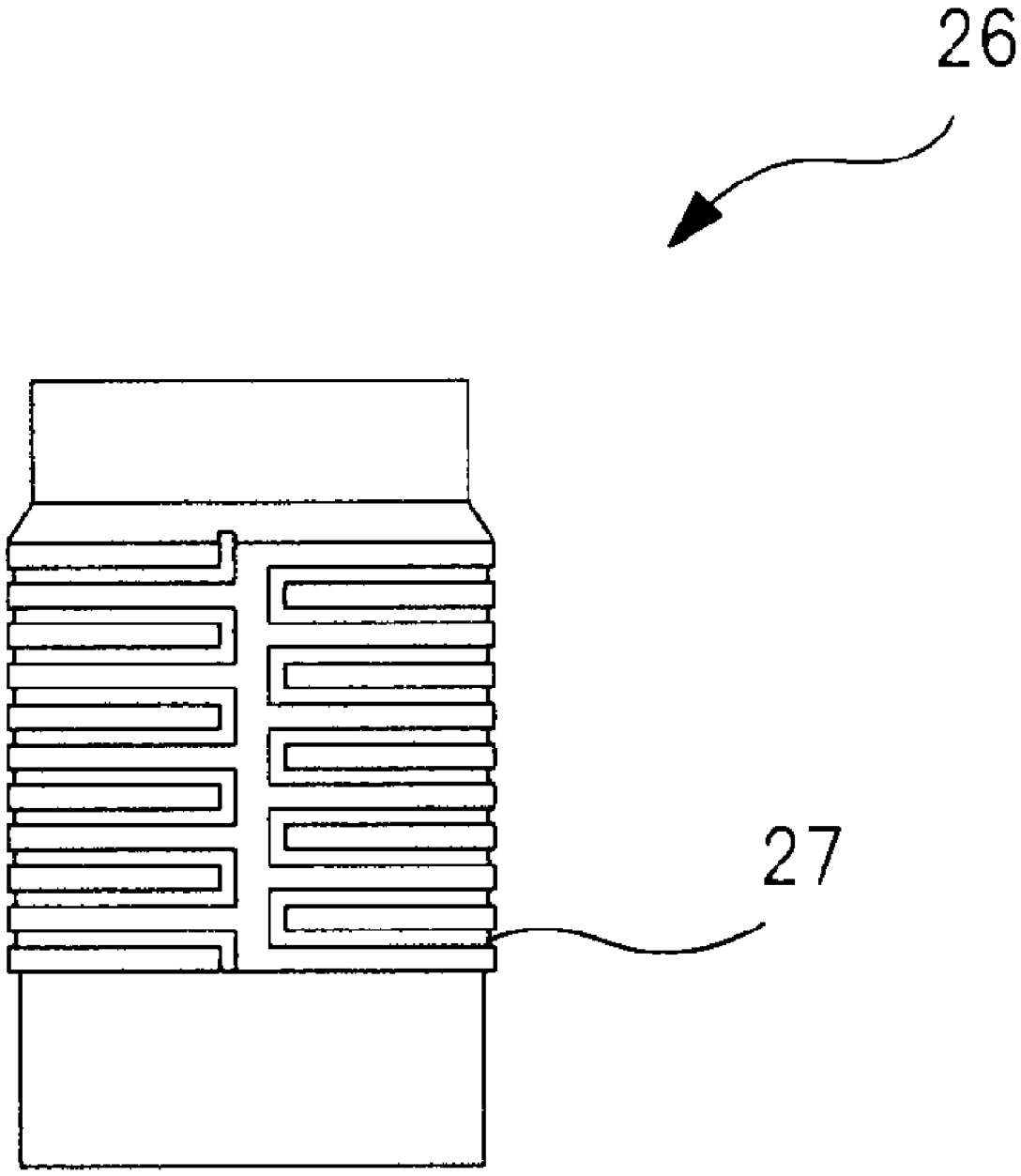
FIG. 9 is a plan view of a constricted passage forming member.

Furthermore, referring to FIG. 1 and FIG. 8, at the front end of the housing 2, a fastener 25 is attached. The front end of the collector 7 is held by this fastener 25. Inside the housing 2 adjoining the fastener 25, a constricted passage forming member 26 such as shown in FIG. 9 is arranged. At the outer circumferential surface of this constricted passage forming member 26, a groove 27 extending in a zigzag shape is formed. When the constricted passage forming member 26 is attached inside the housing 2, the groove 27 and the inner circumferential surface of the housing 2 form a constricted passage 28 for the air. On the other hand, a slight clearance 29 is formed between the outer circumferential surface of the fastener 25 and the inner circumferential surface of the housing 2. Therefore, the air passage 6 is connected to the outside of the housing 2 through the constricted passage 28 and the clearance 29. Note that the ink guide member 5 extends through the inside of the through hole 30 running through the fastener 25.

Now, if the inside pressure of the ink chambers 12 filled with ink rises for some sort of reason, ink will flow out from the ink guide member 5 into the ink outflow chamber 24. In this case, the ink proceeds along the corners 7*d* at the rear end 7*a* of the collector, then reaches the slit 21, then is held inside the ring-shaped grooves 20 or inside the clearance 23 by capillary force. As a result, ink is prevented from flowing out to the outside of the housing 2. On the other hand, if the ink is consumed at the pen tip 3 or the pressure inside the ink chambers 12 filled with ink falls, the ink which was held in the ring-shaped grooves 20 or in the clearance 23 returns through the slit 21 and corners 7*d* to the ink guide member 5. Therefore, the inside of the collector 7 is prevented from being saturated with ink.

In this way, an ink holding force is generated in the collector 7. In this regard, if the ink holding force of the collector 7 is larger than the ink holding force of the clearances 13 around the partition walls 11 of the ink tank 4, the ink in the ink chambers 12 is liable to travel via the ink guide member 5 and ink outflow chamber 24 to reach the collector 7 and the collector 7 is liable to become saturated. Therefore, in this embodiment according to the present invention, the ink holding force of the collector 7 is set to become smaller than the ink holding force of the clearance 13. Specifically, the ink holding force generated at the clearance 23 around the part 7*t* of the collector 7 at the pen tip side is believed to be the greatest among the ink holding forces generated at the collector 7, so the clearance 23 around the part 7*t* at the pen tip side is set to be larger than the clearances 13 around the partition walls 11. That is, speaking in general terms, the smallest clearance 23 formed around the collector 7 is set larger than the clearances 13 around the partition walls 11.

On the other hand, as explained above, the clearance 23 around the part 7*i* of the collector 7 at the ink tank side is set larger than the clearance 23 around the part 7*t* at the pen tip side. This is done for the following reason. That is, when the air in the ink tank 4 expands, the air in the ink tank 4 flows out through the clearance 18 and cutaway part 19 around the end wall 10 into the ink outflow chamber 24. At this time, if the ink holding force of the clearance 23 around the part 7*i* at the ink tank side is strong and a strong ink film is formed at the clearance 23, the flow of air from the ink outflow chamber 24 to the clearance 23 will be obstructed by this strong ink film, so it will become hard for the air in the ink tank 4 to flow out into the ink outflow chamber 24 and the pressure inside the ink tank 4 is liable to rise. Therefore, in this embodiment according to the present invention, the clearance 23 around the part 7*i* at the ink tank side is set large so as to set the ink holding force at this position small. As a result, it becomes hard for an ink film to be formed at the clearance 23 around the part 7*i* at the ink tank side or a weak ink film will be formed.

Here, at the collector 7, as explained above, an ink holding force can be formed not only at the clearance 23, but also at the ring-shaped grooves 20. However, the problem here becomes the ink holding force of the clearance 23, not the ink holding force of the ring-shaped grooves 20. This is because the object is to obtain a good air flow in the clearance 23. Various ways may be considered for setting the ink holding force of the ring-shaped grooves 20, but for example it is also possible to set the ink holding force of the ring-shaped grooves 20 at the part of the collector 7 close to the ink tank 4 larger than the ink holding force at the part of the collector 7 far from the ink tank 4.

Note that if making the clearance 23 larger, the volume of the ring-shaped grooves 20 becomes smaller and the amount of ink which the collector 7 can hold becomes smaller. However, in this embodiment according to the present invention, very little ink flows out from the ink tank 4 to the inside of the air passage 6, therefore there is no problem even if the amount of ink which the collector 7 can hold is reduced. In some cases, the collector 7 may even be omitted.

Next, the pen tip 3 will be explained.

Referring to FIG. 8, the pen tip 3 is provided with a pen tip holder 31 attached to the fastener 25 and a pen tip member 32 attached to the pen tip holder 31. The pen tip holder 31 is for example formed from a plastic, while the pen tip member 32 is for example formed from a metal. These pen tip holder 31 and pen tip member 32 are formed with a through hole 33 running through the pen tip holder 31 and pen tip member 32. At the pen tip member 32 at the front opening of this through hole 33, a writing ball 34 is held to be able to rotate and to be able to move in the longitudinal direction. Further, inside the through hole 33, the ink guide core 35 is housed to be able to move in the longitudinal direction. The front end of the ink guide core 35 abuts against the writing ball 34, and the rear end thereof is held in a recess formed at the front end of the ink guide member 5. By doing this, ink from the ink guide member 5 is guided through the ink guide core 35 to the writing ball 34. Note that so long as ink is guided, the front end of the ink guide member 5 and the rear end of the ink guide core 35 need not abut against each other.

Figure 10A:
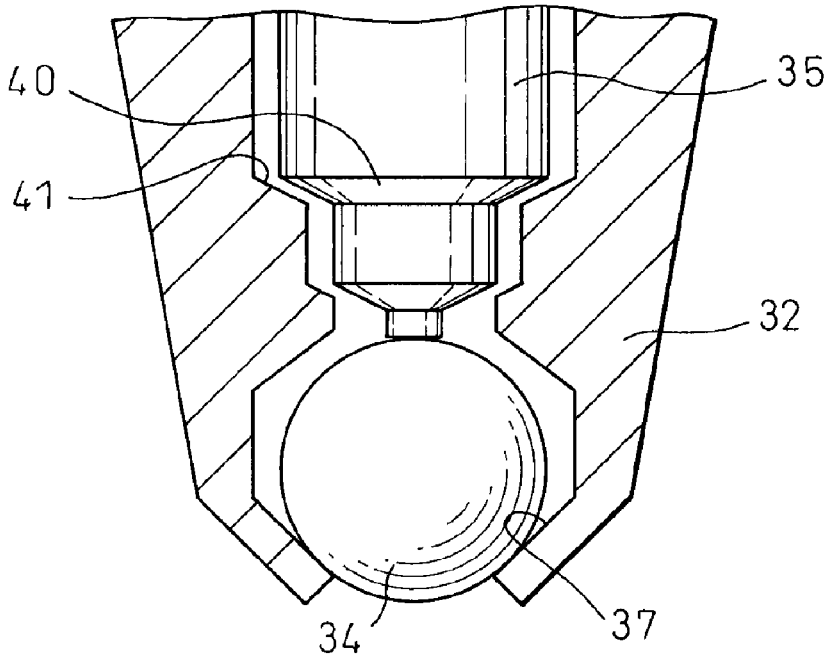
FIGS. 10A and 10B are partial enlarged views of a front end of a pen tip.

Further, a tension spring 36 is arranged between the ink guide core 35 and the pen tip holder 31. This tension spring 36 is used so that the ink guide core 35 is biased toward the writing ball 34. As a result, as shown in FIG. 10A, due to the biasing force of the tension spring 36, the writing ball 34 closely contacts the inner edge 37 formed at the pen tip member 32 whereby a seal is formed.

By doing this, for example when not writing, it is possible to prevent ink from flowing from around the writing ball 34 to the outside due to expansion of air in the ink tank 4. Further, when not writing, it is possible to prevent ink from evaporating from around the writing ball 34 and air from flowing back from around the writing ball 34. In the past, for example, the front end of the pen tip 3 was inserted into a recess formed in a cap so as to prevent ink from flowing to the outside from around the writing ball when not writing. However, in this embodiment according to the present invention, such a cap is not required, therefore it is possible to apply the refill 1 to a knock type ballpoint pen.

Figure 10B:
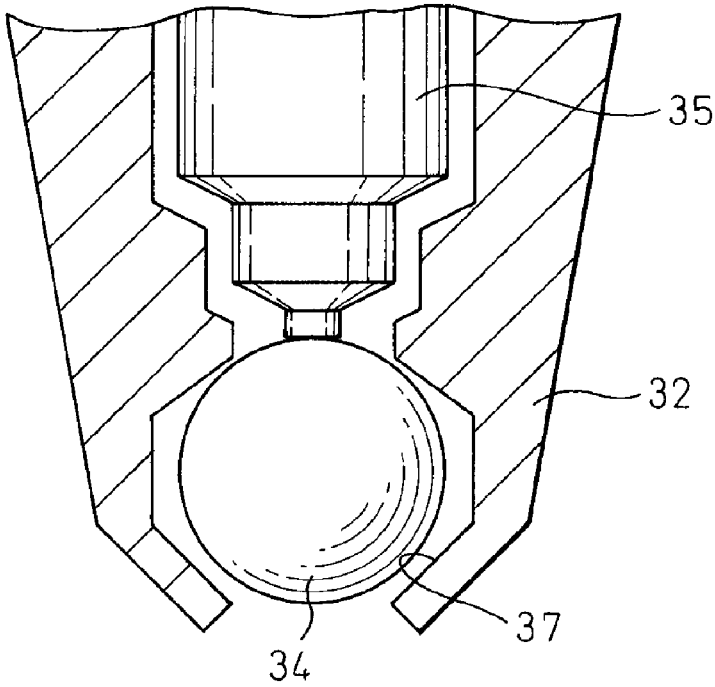

As opposed to this, as shown in FIG. 10B, for example, at the time of writing, if the writing ball 34 is separated from the inner edge 37 against the biasing force of the tension spring 36, ink can flow to the outside from around the writing ball 34.

Figure 11:
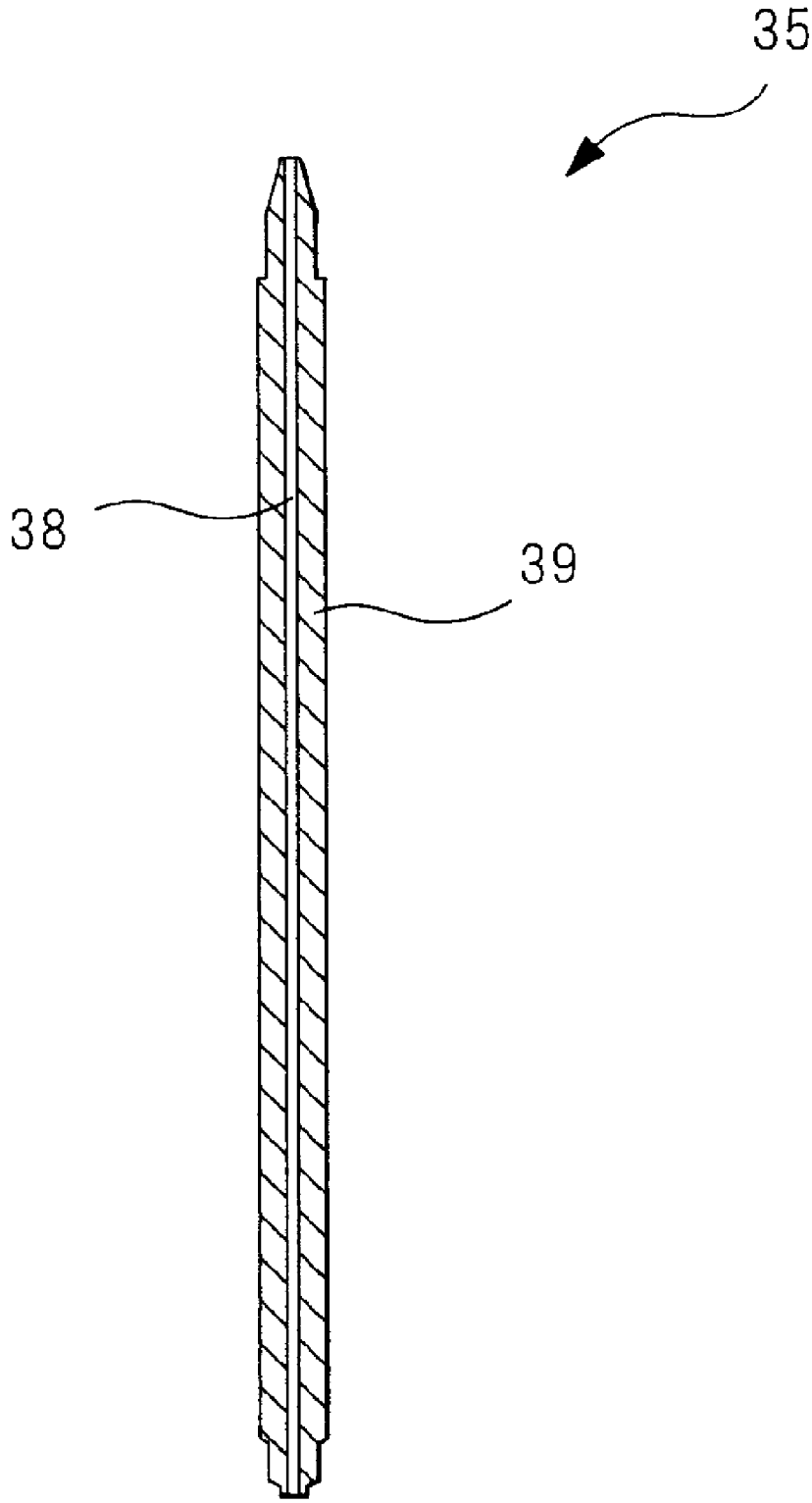
FIG. 11 is a vertical cross-sectional view of an ink guide core.

Furthermore, in an embodiment according to the present invention, as shown in FIG. 11, the ink guide core 35 forms a double layer structure of an inside hard layer 38 and an outside guide layer 39. The inside hard layer 38 is formed harder than the outside guide layer 39, and the front end thereof abuts against the writing ball 34. In this case, the inside hard layer 38 is for example comprised of monofilaments of an extruded plastic. On the other hand, the outside guide layer 39 is comprised of a porous filament body having pores continuing in the longitudinal direction formed by bundling synthetic fibers.

That is, if making the ink guide core 35 from just a porous filament body, the strength of the ink guide core 35 will fall and, if the writing ball 34 is repeatedly pushed against the ball seal 36, the ink guide core 35 is liable to deform or be worn. On the other hand, if making the ink guide core 35 from just plastic monofilaments, it becomes difficult to reliably guide ink to the writing ball 34. Thus, in this embodiment according to the present invention, the ink guide core is made a double layer structure so as to secure durability of the ink guide core 35 and enable ink to be reliably guided to the writing ball 34. Note that the ink guide core 35 may also be a single layer or three or more layers.

Furthermore, the front end of the ink guide core 35 abutting against the writing ball 34, that is, the front end face of the inside hard layer 38, is made flat. By doing this, along with the inside hard layer 38 abutting against the substantial center of the writing ball 34, the writing ball 34 can be biased substantially evenly.

Further, as shown in FIGS. 10A and 10B, the inner circumferential surface of the pen tip member 32 is formed with a step 41 of a shape complementary to a step 40 formed at the outer circumferential surface of the ink guide core 35. The ink guide core 35 can move inside the through hole 33, so for example if excessive impact acts on the pen tip member 32, the ink guide core 35 is liable to excessively vibrate and as a result air bubbles are liable to form in the ink around the ink guide core 35. If air bubbles form in this way, the ink will no longer be discharged well. Thus, in this embodiment according to the present invention, a step 41 complementary with the step 40 of the ink guide core 35 is formed at the pen tip member 32 so that the clearance between the outer circumferential surface of the ink guide core 35 and the inner circumferential surface of the pen tip member 32 becomes small. This is because if this clearance becomes small, air bubbles become harder to form.

Up to here, the case of application of present invention to a refill of a ballpoint pen is explained. However, the present invention can also be applied to a ballpoint pen itself, a fountain pen, a felt tip pen, etc. When applying the present invention to a ballpoint pen itself, the above housing 2 of the refill 1 forms the housing of the ballpoint pen body.

LIST OF REFERENCE NUMERALS

1 . . . refill
2 . . . housing
3 . . . pen tip
4 . . . ink tank
5 . . . ink guide member
6 . . . air passage
7 . . . collector
8 . . . insertion member
11 . . . partition wall
12 . . . ink chamber
13 . . . clearance
14 . . . guide member receiving hole
15 . . . ink guide path
16 . . . support projection
23 . . . clearance
31 . . . pen tip holder
32 . . . pen tip member
33 . . . through hole
34 . . . writing ball
35 . . . ink guide core
36 . . . tension spring
37 . . . inner edge
38 . . . inside hard layer
39 . . . outside guide layer

The invention claimed is:

1. A writing implement provided with
a housing,
a pen tip attached to a front end of the housing,
an ink tank formed inside the housing,
an ink guide member guiding ink inside the ink tank to the pen tip, and
an air passage formed between the ink tank and the pen tip in the housing and having one end connected to an end of the ink tank at the pen tip side and another end connected to the outside of the housing, wherein
the inside of the ink tank is divided by partition walls into a plurality of ink chambers arranged in the longitudinal direction, and the ink in these ink chambers is guided from the ink chambers close to the pen tip successively to the pen tip by the ink guide member,
a substantially uniform clearance provided around the entire circumference between the outer circumferential surface of each partition wall and the inner circumferential surface of the ink tank, and the ink is held inside the ink chambers by a ring-shaped ink film formed in the clearance, while air is made to flow into the ink chambers through the clearances.

2. A writing implement as set forth in claim 1, wherein the partition wall is formed on an insertion member, said insertion member is inserted into the ink tank so as to define the ink chambers in the ink tank, and said insertion member is provided with, at an intermediate position in the longitudinal direction, support projections abutting against the inner circumferential surface of the ink tank to support said insertion member.

3. A writing implement as set forth in claim 2, wherein a guide member receiving hole passing through the partition wall and extending in the longitudinal direction is formed in the insertion member, said guide member receiving hole receives the ink guide member, and the wall surface of said guide member receiving hole is provided with ink guide paths so that ink in the ink chambers is led to the ink guide member through said ink guide paths.

4. A writing implement as set forth in claim 1, wherein a collector is arranged in the air passage, ink flowing out from the ink guide member positioned in the air passage to the inside of the air passage is held by said collector and said held ink is returned from said collector to the ink guide member.

5. A writing implement as set forth in claim 4, wherein an ink holding force of the collector is set so as to become smaller than an ink holding force of a clearance formed between the outer circumferential surface of the partition wall and the inner circumferential surface of the ink tank.

6. A writing implement as set forth in claim 5, wherein a minimum clearance formed between the outer circumferential surface of the collector and the inner circumferential surface of the housing is set larger than the clearance formed between the outer circumferential surface of the partition wall and the inner circumferential surface of the ink tank.

7. A writing implement as set forth in claim 4, wherein an ink holding force at a clearance formed between the outer circumferential surface of the collector and the inner circumferential surface of the housing at the part of the collector at the ink tank side is set smaller than an ink holding force at a clearance formed between the outer circumferential surface of the collector and the inner circumferential surface of the housing at the other part of the collector.

8. A writing implement as set forth in claim 7, wherein a clearance formed between the outer circumferential surface of the collector and the inner circumferential surface of the housing at the part of the collector at the ink tank side is set larger than a clearance fanned between the outer circumferential surface of the collector and the inner circumferential surface of the housing at the other part of the collector.

9. A writing implement as set forth in claim 1, wherein the pen tip is provided with a writing ball held at a pen tip member, an ink guide core housed in the pen tip member and guiding ink from the ink guide member to said writing ball, which ink guide core abuts against said writing ball at its front end, and a biasing means biasing said ink guide core toward the writing ball, wherein the biasing force of said biasing means causes the ink guide core to make the writing ball closely contact an inner edge of the pen tip member to form a seal, and wherein ink is able to flow out from around the writing ball when the writing ball separates from the inner edge.

10. A writing implement as set forth in claim 9, wherein the ink guide core is comprised of an inside hard layer with a front end abutting against the writing ball and an outside ink guiding layer guiding the ink.

11. A writing implement as set forth in claim 10, wherein a step of a shape complementary with a step formed at the outer circumferential surface of the ink guide core is formed at the inner circumferential surface of the pen tip member.

12. A writing implement as set forth in claim 1, wherein the ink is comprised of a water-based ink with a viscosity of 10 Pa·s or less.

* * * * *